United States Patent [19]

Ball

[11] 4,090,366

[45] May 23, 1978

[54] TRANSIT CAPSULES

[75] Inventor: Kenneth Ball, Hightown, England

[73] Assignee: Vickers-Intertek Limited, London, England

[21] Appl. No.: 766,007

[22] Filed: Feb. 7, 1977

Related U.S. Application Data

[62] Division of Ser. No. 685,676, May 12, 1976, which is a division of Ser. No. 456,769, Apr. 1, 1974, Pat. No. 3,968,656.

[51] Int. Cl.[2] ..... B63C 11/34

[52] U.S. Cl. ..... 61/69 R

[58] Field of Search ..... 61/69 R, 69 A; 166/.5

[56] References Cited

U.S. PATENT DOCUMENTS 1,929,168 10/1933 Grieshaber ..... 61/69 R 3,855,806 12/1976 Therisien ..... 61/69 R

*Primary Examiner*—Paul R. Gilliam

*Assistant Examiner*—David H. Corbin

*Attorney, Agent, or Firm*—Scrivener, Parker, Scrivener and Clarke

[57] ABSTRACT

A transit capsule for providing operator access to a sub-sea installation part in a capsule on a sea-bed, the two capsules having complementary means to form a conjunction capsule, has means selectively connecting an expansion vessel in the transit capsule to the other two capsules; on connecting the said other two capsules which are water-filled, their pressures are reduced to the atmospheric pressure in the transit capsule with only a small amount of water being ejected to balance the pressure and this small amount can be inspected to determine the state of the said other two capsules by suitable inspection means.

8 Claims, 4 Drawing Figures

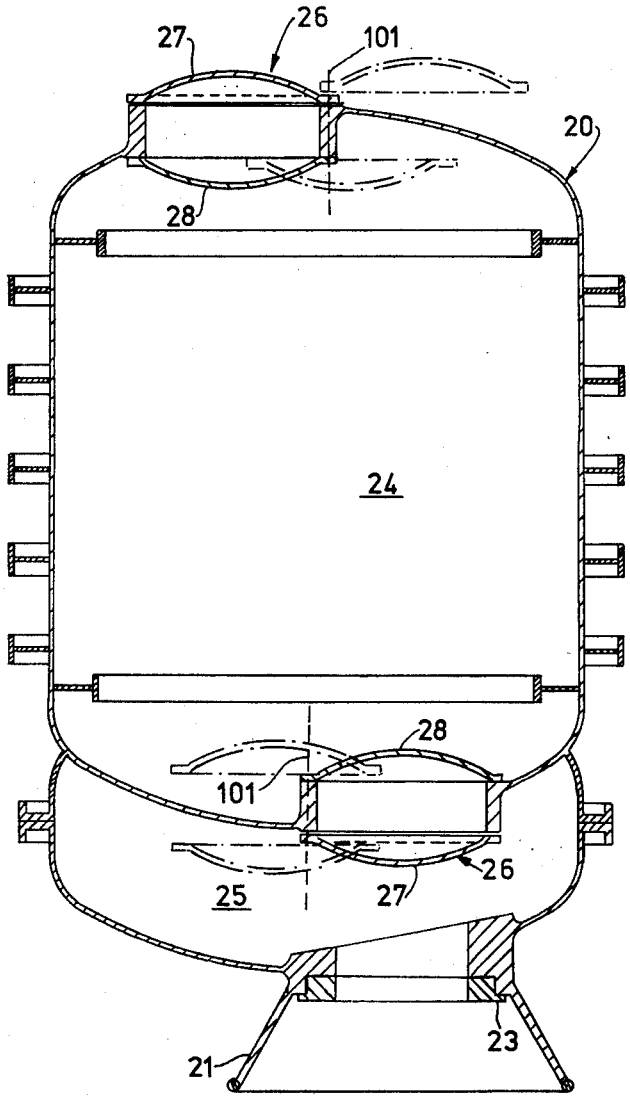
—FIG. 2—

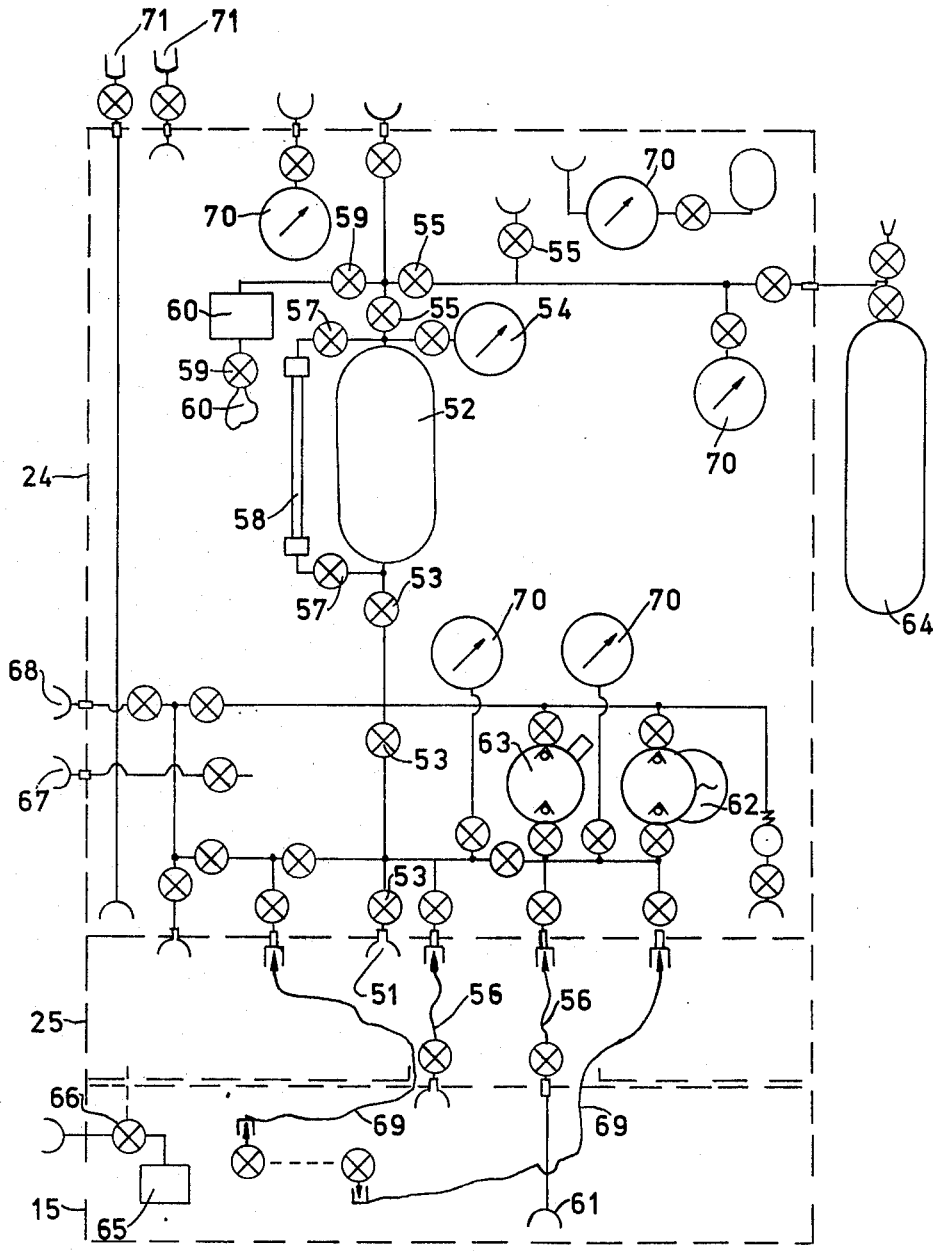
—FIG. 3—

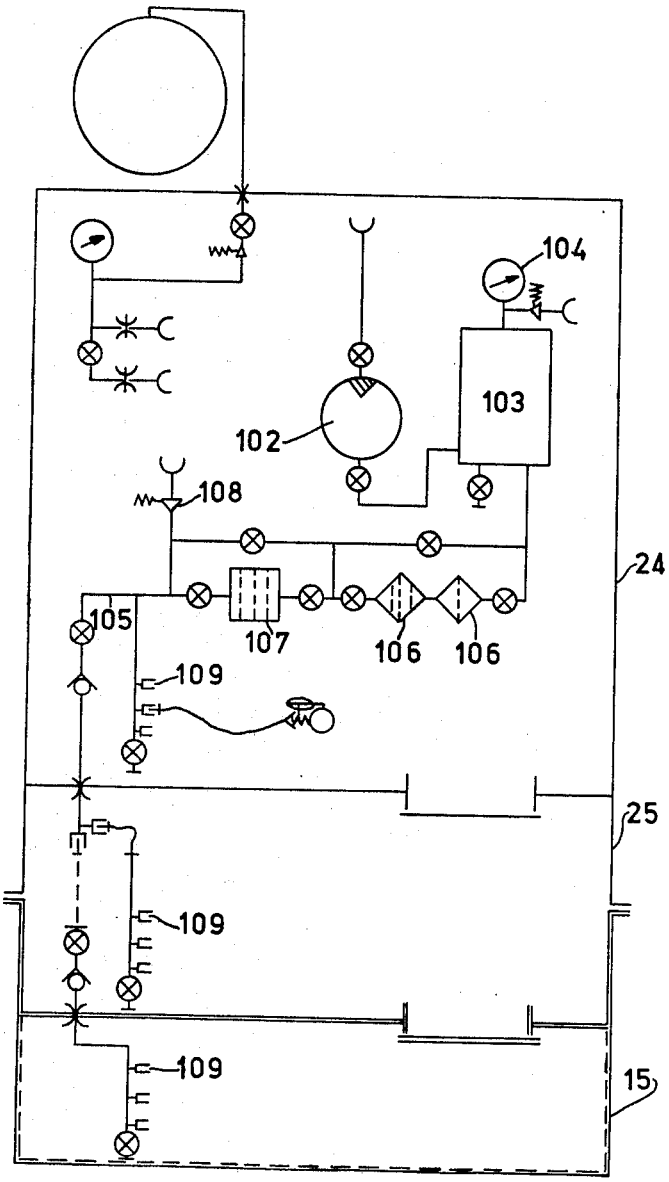
—FIG. 4—

TRANSIT CAPSULES

This application is a division of Application Ser. No. 685,676 filed May 12, 1976 which in turn is a division of Application Ser. No. 456,769, filed Apr. 1, 1974, now U.S. Pat. No. 3,968,656. The present invention concerns transit capsules for gaining operator access to a sealed capsule containing part of a sub-sea installation.

A transit capsule has means for co-operating with complementary means on the sea-bed to form a sealed conjunction capsule which encloses, or permits access to a further capsule enclosing, an installation part. The present invention concerns a transit capsule for use when there is a said further capsule. In the prior art, the conjunction capsule is pumped dry to allow access to the installation part therein or access to the sealed installation part further capsule which is left filled with gas at atmospheric pressure between socalled interventions. U.S. Pat. Application No. 685,676 however proposes that the installation part capsule is left filled with water which between interventions at or near external sea pressure but during interventions is reduced to atmospheric pressure; the conjunction capsule remaining water-filled as well and also being reduced in pressure during interventions. Unlike the prior art, the contents of the conjunction and installation part capsules remain unchanged except in pressure. There is thus a risk that leakage from the installation part of, say, oil will contaminate the working environment.

Accordingly the present invention provides a transit capsule having means for co-operating with complementary means on a sea-bed capsule sealingly enclosing an installation part on which a function is to be performed, which sea-bed capsule is intended to be full of water initially at or near pressure of the surrounding sea, to form a sealed conjunction capsule through which access can be obtained to the sea-bed capsule, characterised by the provision of an expansion vessel, means for selectively connecting the expansion vessel to the conjunction capsule and to the installation part capsule whereby the pressures in the conjunction capsule and the installation part capsule will be reduced by the expulsion of a small part of their substantially incompressible contents into the expansion vessel, and means for inspecting the said small part.

The inspecting means can inspect said small part quantatively and/or qualitatively. The quantity of the the said small part from the conjunction capsule will indicate the integrity of the conjunction capsule and the small amount from the installation part capsule will indicate the integrity of the installation part capsule and any gas leakage into the installation part capsule and any gas leakage into the installation part capsule from the installation part. Qualitative inspection of the small amount from the installation part capsule will show any oil leakage into the installation part capsule. Having determined that there is leakage, the leak would be stopped by operating valves which would be associated with the installation part and the contamination would be flushed out. Minimal energy would be required for flushing out since the installation part capsule would be sealed off and restored to sea pressure with the result that a flushing flow of sea water from the external sea whilst at high absolute pressure needs only a small pressure head.

An embodiment of the invention will now be described, by way of example with reference to the accompanying drawings.

THE DRAWINGS

FIG. 2 shows a transit module,

Figure 1:
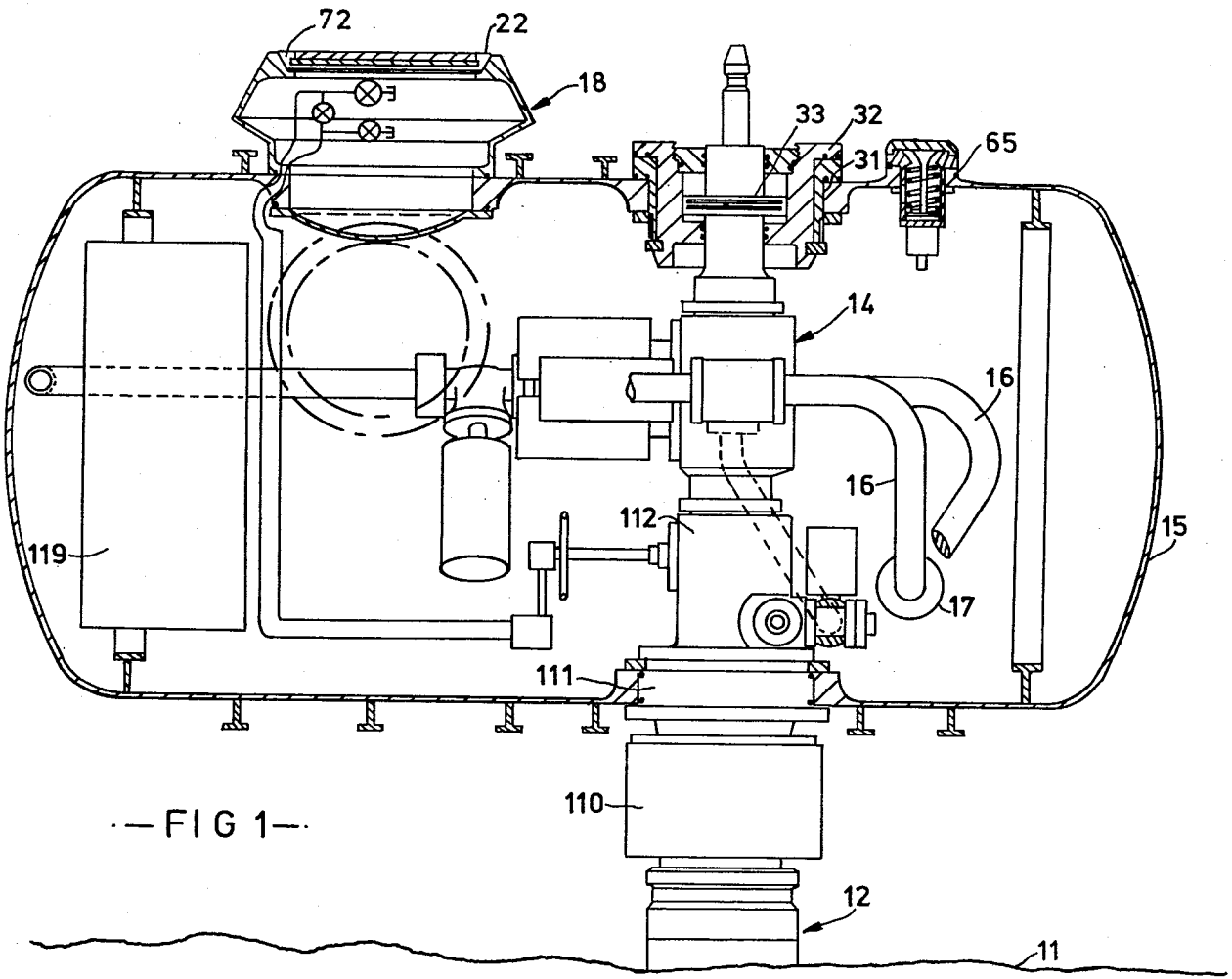
FIG. 1 shows part of a sea bed installation enclosed in a capsule.

FIG. 3 is a schematic circuit diagram showing means for regulating water pressure in various schematically shown capsules, the means including an expansion vessel, means for selectively connecting the expansion vessel to the conjunction capsule and the installation part capsule and means for examining the flow therefrom, and FIG. 4 is a schematic circuit diagram of a preferred arrangement for providing a supply of breathing air to any personnel undertaking work within the installation part capsule.

DETAILED DESCRIPTION OF THE EMBODIMENT

FIG. 1 shows a portion of the sea-bed 11 from which well head casings 12 project. On the casings are mounted a connector 111 forming the foot of a christmas tree 14. The christmas tree is enclosed in a sealed sub-sea installation part capsule 15. Pipes 16 are brought through suitable penetrations 17 in the wall of the capsule to connect up to the christmas tree. A hatch 18 is provided on the top of the capsule. Seals (not shown) between the casings, the connector, and the member may leak but these seals are outside the capsule. The member is a solid block which penetrates the ca capsule wall and contains a master valve which is operable manually or by remote hydraulic control arranged not to interfere with each other.

FIG. 2 shows a transit module 20 which can be guided down to the installation part capsule 15 by any of the known means such as guide wires (not shown). At the bottom of this module there is an entry fairing 21 to receive the hatch and to guide a sealing surface 22 around the hatch 18 onto a complementary sealing surface 23 on the module 20.

The module 20 comprises an upper, transit, capsule 24 and a lower chamber which is normally open at its lower end at the fairing 21 but which is sealed by the co-operation of the sealing surfaces to form a third, conjunction, capsule. The chamber will hereinafter be referred to as the capsule 25.

The capsule 24 has double hatches 26 at its lower and upper ends. The upper double hatch is for the entry of personnel and equipment at the sea-surface and the lower double hatch is to give access to the conjunction capsule 25. The double hatches are designed with an outer member 27 to resist external pressure and an inner member 28 to resist pressure within the capsule 24; this allows the capsule to be used normally and as a decompression chamber if the capsule by any mishap becomes pressurised whilst containing personnel as might occur if a leak commenced when personnel were in the capsule 15 and the lower double hatch had to remain open to allow them to re-enter the capsule 24. The personnel could then seal themselves into the capsule at whatever pressure existed and escape to the surface relying on the air in the capsule 24 and possibly external connectors for enabling support vessels to supply further air when on the surface but before it would be safe to leave the capsule because of insufficient decompression. The members of each double hatch pivot about a single pin 101 parallel to the axis of the hatch.

The hatch 18 can be designed to resist major pressure within the capsule 15 only since the capsule is preferably at full hydrostatic pressure except when the pressure across this hatch is balanced at atmospheric pressure.

The christmas tree 14 projects through the capsule 15 being rigidly sealed to the bottom of the capsule and being slidably sealed in a port 31 at the top of the capsule to allow for relative expansion and to allow for connection of wire-line or other auxiliary units 110(FIG. 8) which would be at the top of the tree. The form of this sliding seal is a rigid collar 32 fast to the port 31 within which collar there is a piston 33 which can be used as a hydrostatic bearing and as a jack to lift elements of the tree of their seatings prior to being removed.

FIG. 3 shows a circuit diagram of means for regulating water pressures. This Figure is rather complex due to the large amount of designed redundancy and it is thought best described by an explanation of how it is used. First it is to assumed that the three capsules 15, 24 and 25 (shown in this Figure in broken lines) are filled, capsule 24 with air at atmospheric pressure and the other two capsules with water at external pressure. A pressure bleed 51 is connected to an expansion tank 52 by means of valves 53. The pressure bleed is provided in or by-passing the lower double hatch 26. The expansion tank is a pressure vessel and initially its pressure rises as sensed by a pressure gauge 54. If there is a leak on the sealing surfaces 22 and 23 the pressure would rise to the external pressure. However normally the pressure rise will be limited indicating the absence of any leak and the expansion tank can be vented to the transit capsule pressure by valves 55. The double hatch can now be opened and access gained to the conjunction capsule 25 to enable flexible connections 56 to be made to the capsule 15 through or bypassing the hatch 18. One of these connections is a pressure bleed and this again is routed by the valves 53 to the expansion tank 52 except that the initial flow is by-passed by valves 57 through a sight glass 58 so that the nature of the flow can be observed and possibly by valves 59 to analytical apparatus 60. A compressed gas cylinder 64 can blow the contents of the apparatus 60 into the external sea or capsule 15 or 25. If the initial flow is oil or gas it is possible to flush any remaining oil or gas from the capsule 15 by pumping water through the other of the flexible connections 56 to an outlet 61 below the expected lowest level of gas or oil by a power driven pump 62 or a hand driven pump 63. This oil or gas would result from a leakage from the well head installation and can be severely limited by means 65 which comprises any one or combination of an oil detector, a gas detector, a differential pressure detector, a pressure relief valve and a frangible diaphragm. This means is disposed in the upper part of the capsule 15 which is so arranged as to provide an oil and gas catchment area around the means. Any detectors used in the means are arranged to prevent further leakage by closing off the well head either by direct mechanical operation or by electrical or hydraulic connections. Preferably the means, or some of it, is disposed to be accessible for closing off purposes from the conjunction capsule. If a pressure relief valve or diaphragm is used, a valve 66 operable from within the capsule 25 is used to isolate the relief valve or diaphragm from the external pressure to allow the pressure relief valve or diaphragm to be serviced. The water which is pumped through the outlet 61 is drawn from a sea connection or possibly from the tank 52 and discharged through another sea connection 68 or a pressure relief valve in the means 65; if oil pollution is to be minimised, it is possible to store the flushed oil in the tank 52 or another tank. In cases where it is impossible to limit the amount of oil leakage, it would be possible to have a diving-bell-like collector to receive any oil coming from the sea connection 68. After all the oil and gas has been flushed out, the pressure in the capsule can be reduced as described in relation to capsule 25 and the hatch opened. Access can then be gained to the well head installation. Since this is still immersed in water which can be fifteen foot deep, it is necessary to have shallow water diving support means, i.e. an air supply system including a compressor 102 (FIG. 4) so that the personnel do not have to suck air against the pressure head of the water in the capsule 15. Each person has a demand valve in his breathing equipment to reduce the air pressure to that required at his working depth. Since even if the capsule becomes pressurised whilst occupied, the pressures in the other capsules will increase by the same amount, the pressure head generated by the compressor does not have to be large. The compressor 102 draws in air from the transit capsule and delivers it to a reservoir 103 controlled by a settable relief valve 104 and thence to a breathing manifold 105 through filters 106 and carbon dioxide absorbing means 107. The pressure in this manifold is controlled by a valve 108. Suitable connecting points 109 for drawing off air are provided on the manifold.

FIG. 3 also illustrates flexible connections 69 which can be used to flush equipment within the capsule 15 if required, pressure guages 70 and external connections 71 to enable the capsule 24 to be used as a decompression chamber or diving bell.

The transit capsule can be a self-propelled vehicle (a miniature submarine).

I claim:

1. A transit capsule for transporting personnel in an atmospheric pressure air environment down to a sea-bed capsule enclosing an installation part and remaining in use full of water, said transit capsule having means for co-operating with complementary means on the sea-bed capsule to form a sealed conjunction through which access can be gained from the transit capsule to the sea-bed capsule, the improvements residing in the provision in the transit capsule of an expansion vessel for receiving that small part of the virtually incompressible water in the conjunction and sea-bed capsules which corresponds to the difference in the amounts of water held thereby at a pressure corresponding to the hydrostatic head of the sea depth and at atmospheric pressure, of means for selectively connecting the expansion vessel to the conjunction and sea-bed capsules for the passage of the said small part into the expansion chamber and allowing the pressures in all three capsules to equal each other and the atmospheric pressure in the transit capsule, and of means for inspecting said small part.

2. A transit capsule according to claim 1 wherein the inspecting means senses the amounts of said small part.

3. A transit capsule according to claim 2 wherein the inspecting means comprises a pressure guage for sensing the pressure rise in the expansion vessel and thus the amount of the said small part.

4. A transit capsule according to claim 1 wherein the inspecting means comprises means for detecting the nature of the said small part.

5. A transit capsule according to claim 4 wherein the said detecting means comprises a sight glass.

6. A transit capsule according to claim 4 wherein the detecting means comprises analytical apparatus.

7. A transit capsule according to claim 1 having a pump, a sea water inlet, and means for directing a purging flow of sea water from the inlet through the pump into the installation part capsule from which it leaves through a pressure relief valve or to an outlet in the transit capsule, whereby the purging flow can be kept at a mean pressure corresponding to that of the external sea whilst requiring a minimal head to create the purging flow.

8. A transit capsule according to claim 1 provided with shallow water diving support means whereby personnel from the transit capsule can enter the installation part capsule whilst it is full of water but at reduced pressure simulating shallow water irrespective of the depth of the installation capsule in the sea.

* * * * *